US005815123A

United States Patent [19]

Uematsu et al.

[11] Patent Number: 5,815,123

[45] Date of Patent: Sep. 29, 1998

[54] NRD GUIDE AND NRD GUIDE ELEMENT

[75] Inventors: Hiroshi Uematsu; Ken-ichi Ogawa, both of Wako, Japan

[73] Assignee: Honda Giken Kogyo Kabushiki Kaisha, Tokyo, Japan

[21] Appl. No.: 484,176

[22] Filed: Jun. 7, 1995

[30] Foreign Application Priority Data

Aug. 25, 1994 [JP] Japan ..... 6-201144

[51] Int. Cl.[6] ..... H01Q 13/00; H01P 3/16

[52] U.S. Cl. ..... 343/785; 333/248; 333/239

[58] Field of Search ..... 343/785; 333/239, 333/248; H01Q 13/00; H01P 3/16

[56] References Cited

U.S. PATENT DOCUMENTS

| | | | |
|---|---|---|---|
| 4,463,330 | 7/1984 | Yoneyama | 333/248 |
| 5,416,492 | 5/1995 | Takahashi et al. | 333/237 |
| 5,473,296 | 12/1995 | Ishikawa et al. | 333/248 |

*Primary Examiner*—Hoanganh T. Le
*Attorney, Agent, or Firm*—Lyon & Lyon LLP

[57] ABSTRACT

An innovative nonradioactive dielectric waveguide (NRD guide). Protrusions are separately formed on a surface of a dielectric strip. Recesses corresponding to the protrusions are formed on a parallel conductive plate. The dielectric strip is set between top and bottom parallel conductive plates such that the small protrusions on the dielectric strip are fitted into the recesses on the bottom parallel conductive plate.

7 Claims, 6 Drawing Sheets

NRD GUIDE AND NRD GUIDE ELEMENT

FIELD OF THE INVENTION

The present invention relates to a nonradioactive dielectric waveguide (hereinafter a "NRD guide") fabricated by inserting a dielectric strip between top and bottom parallel conductive plates and a circuit element using the NRD guide and, more particularly, to a NRD-guide circuit element and a NRD guide whose fabrication performance is improved by simplifying the positioning of the dielectric strip and making it possible to prevent the position of the dielectric strip from deviating.

DESCRIPTION OF THE RELATED ART

FIG. 6 is a perspective view showing the basic structure of an existing NRD guide.

The existing NRD guide includes a structure for cutting off the propagation of an electromagnetic wave of polarized electromagnetic radiation parallel with a wall surface. This is accomplished by decreasing to a half wavelength or less an interval between top and bottom parallel conductive plates 101 and 102, each of which may comprise a metallic plate or the like; inserting a dielectric strip 103 between the plates 101 and 102; and propagating the electromagnetic wave along the dielectric strip 103. The material of the dielectric strip 103 preferably comprises Teflon which has a small dielectric loss and a small electromagnetic wave propagation loss. The NRD guide 100 may be fabricated by establishing a setting position of the dielectric strip 103 with a not-illustrated positioning jig or the like and bonding and securing the dielectric strip 103 between the top and bottom parallel conductive plates 101 and 102 with an adhesive made of an epoxy-based resin or the like.

Because the adhesiveness between Teflon and metal is not satisfactory, the present applicant developed a NRD guide (nonradiative dielectric waveguide) shown in FIG. 7, which assures the positioning and holding of the dielectric strip 103 for a long time while withstanding environmental changes and impacts given from the outside. This is accomplished by forming a dam 104 made of an adhesive at the boundary between the parallel conductive plates 101 and 102 and the dielectric strip 103 along the dielectric strip 103, as shown in Japanese Laid-Open Patent Application No. Hei-6-45807.

However, when considering the mass production of an existing NRD guide and a circuit element using the NRD guide, it has been desired to improve the fabrication performance of the dielectric strip 103 because setting and positioning of the dielectric strip 103 is quite labor intensive (i.e., requires a many man-hours), and it is quite difficult (generally not possible) to obtain desired characteristics if a positional deviation occurs.

SUMMARY OF THE INVENTION

It is an object of the present invention to provide an innovative NRD guide which provides for simplified setting and positioning of a dielectric strip and makes it possible to prevent deviation in the position of the strip. It is also an object of the present invention to provide a circuit element using the NRD guide. To achieve the above objects, a NRD guide in accordance with the present invention and the NRD-guide circuit element of the present invention are characterized by using a structure in which at least two small protrusions are separately formed on the joint surface between a dielectric strip and a parallel conductive plate, a recess fitting the small protrusion is formed at a predetermined position of the parallel conductive plate, and the dielectric strip is set between top and bottom parallel conductive plates in a manner such that a small protrusion formed on the dielectric strip is fitted into the recess formed on the parallel conductive plate and positioned.

Because the small protrusion formed on the dielectric strip fits the recess formed on the parallel conductive plate, the dielectric strip is securely positioned and positional deviation is minimized or eliminated. Further, because in a preferred form at least two small protrusions may be separately formed on the joint surface of the dielectric strip and the parallel conductive plate, the dielectric strip is not rotated. Thus, the dielectric strip can easily be set and positioned, the position of the dielectric strip can be prevented from deviating, and the fabrication performance of the dielectric strip can be improved.

Moreover, it is possible to fabricate a NRD guide and a NRD-guide element by (1) forming a recess on a bottom parallel conductive plate, (2) providing a small protrusion on a joint surface of a dielectric strip, (3) applying a gluing agent or the like to the joint surface of the dielectric strip, (4) setting the dielectric strip on the conductive plate such that the small protrusion on the joint surface of the dielectric strip fits in the recess of the conductive plate, and (5) holding the dielectric strip temporarily fixed with the adhesive by the top and bottom parallel conductive plates. Furthermore, it is possible to fabricate a NRD guide and a NRD-guide element by setting the dielectric strip while keeping the bottom parallel conductive plate almost horizontal, then superimposing the top parallel conductive plate on it, and holding the dielectric strip by the top and bottom parallel conductive plates without using any adhesive or gluing agent.

BRIEF DESCRIPTION OF THE DRAWINGS

FIG. 1(*b*) is a first sectional view of the NRD guide illustrated in FIG. 1(*a*);

FIG. 1(*c*) is a second sectional view of the NRD guide illustrated in FIG. 1(*a*);

FIG. 2(*b*) is a sectional view of the linear waveguide element shown in FIG. 2(*a*);

FIG. 3(*b*) provides a more detailed view of the dielectric strip used in the antenna shown in FIG. 3(*a*);

FIG. 3(*c*) provides a side view of the dielectric strip shown in FIG. 3(*b*);

FIG. 5(*b*) is a cross-sectional view of the FM radar module shown in FIG. 5(*a*);

DETAILED DESCRIPTION

A presently preferred embodiment of the present invention is described below in detail by referring to the accompanying drawings.

Figure 1A:
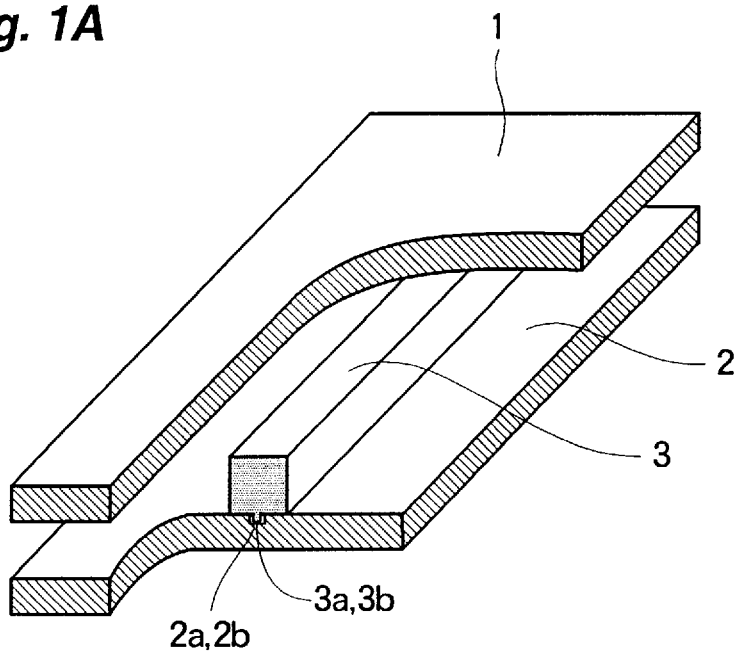
FIG. 1(*a*) is an illustration of a NRD guide in accordance with one preferred form the present invention.
Figure 1B:
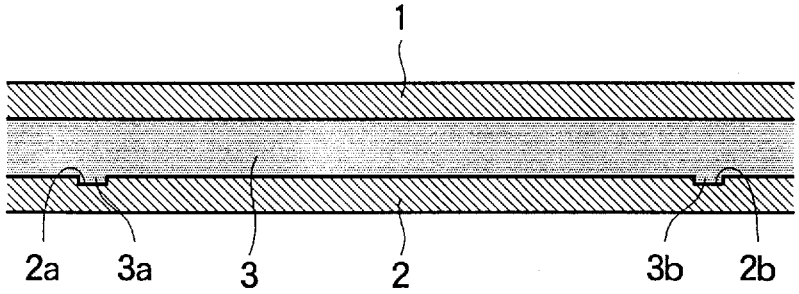
Figure 1C:
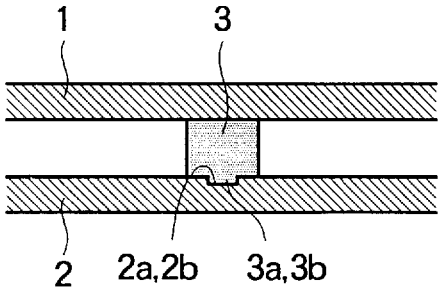

FIGS. 1(*a*)–1(*c*) provide several views of a NRD guide in accordance with a preferred form of the present invention. More particularly, FIG. 1(*a*) is a perspective view of the NRD guide and FIGS. 1(*b*) and 1(*c*) are sectional views of the NRD guide.

Two small protrusions 3*a* and 3*b* are separately formed at the bottom of a dielectric strip 3 inserted between top and bottom parallel conductive plates 1 and 2 in the longitudinal direction of the strip 3 to hold the strip 3 by the top and bottom parallel conductive plates 1 and 2 while making the small protrusions 3*a* and 3*b* fit recesses 2*a* and 2*b* formed on the bottom parallel conductive plate 2.

Figure 2A:
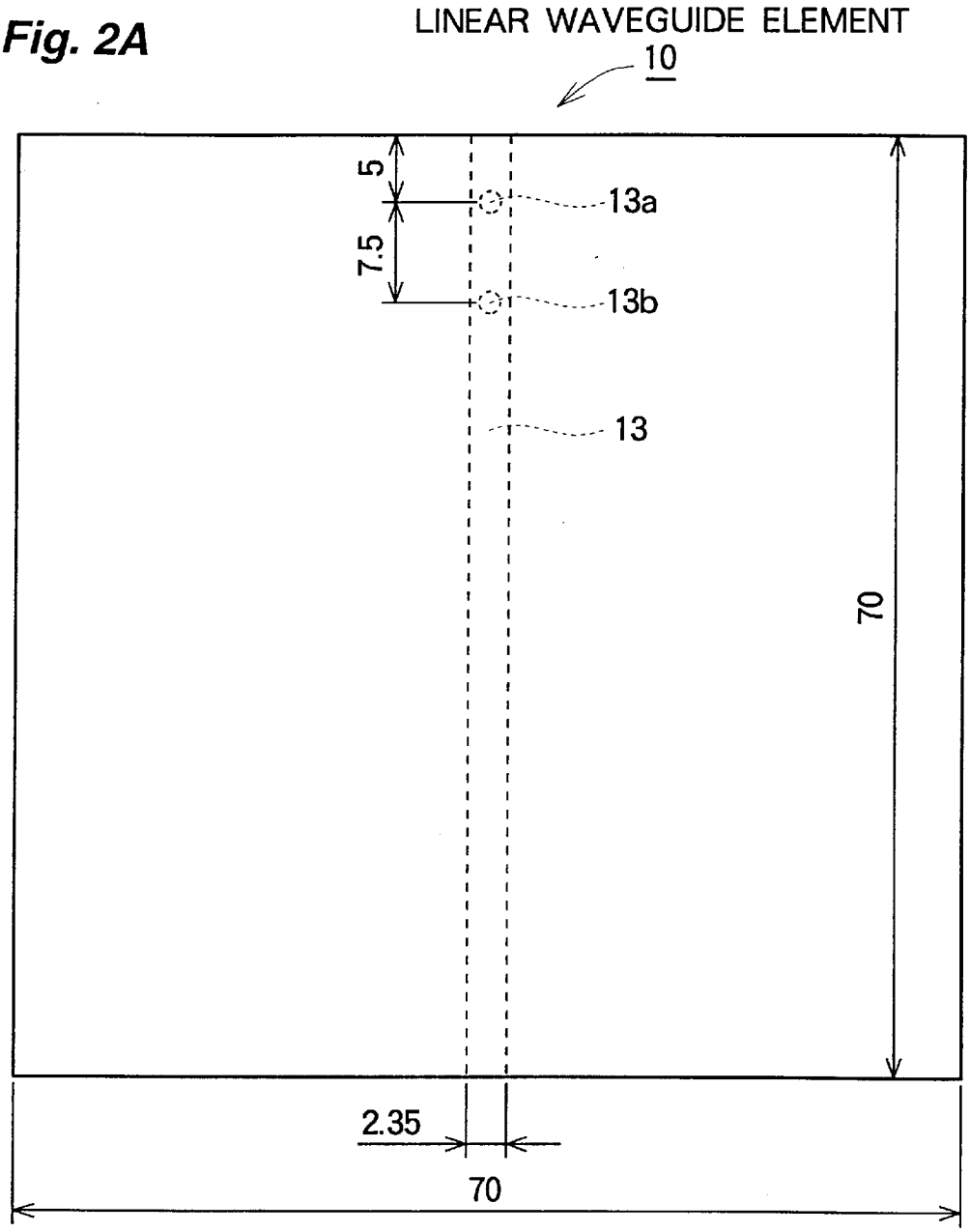
FIG. 2(*a*) is an illustration of a linear waveguide element used for measurement of transmission loss.
Figure 2B:
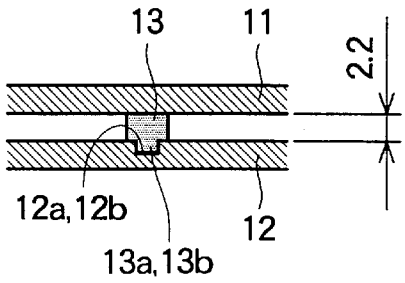

FIGS. 2(*a*) and 2(*b*) provide an illustration of a linear waveguide element used for measurement of a transmission loss. FIG. 2(*a*) provides a top view of the waveguide element and FIG. 2(*b*) provides a sectional view of that element. The linear dielectric strip 13 preferably is made of Teflon, has a width of 2.35 mm, a height of 2.2 mm, and a length of 70 mm, and has two small protrusions 13*a* and 13*b* formed thereon. One small protrusion 13*a* may be formed at a position 5 mm away from one end of the linear dielectric strip 13, and a small protrusion 13*b* may be formed at a position 7.5 mm away from the small protrusion 13*a*. Further, in a preferred form, the small protrusions 13*a* and 13*b* may be cylindrical and have a diameter of 1.6 mm and a height of 0.8 mm respectively (their front ends may be chamfered).

The bottom parallel conductive plate 12 is provided with recesses 12*a* and 12*b* into which the small protrusions 13*a* and 13*b* are fitted so that the dielectric strip 13 is set to a predetermined position. In a preferred form, the recesses 12*a* and 12*b* may have a diameter of 1.6 mm or more and a depth of approx. 0.9 mm so that the joint surface of the dielectric strip 13 closely contacts the parallel conductive plate 12, deviation in the fitted state is minimized, and positioning is accurately performed. The parallel conductive plate 12 may have a length and a width of 70 mm respectively. As the result of measuring the transmission loss of the linear waveguide element 10 having the above shape at a frequency of 60 GHz, it is found that the transmission loss is increased by 0.8 to 0.9 dB for 70 mm (approx. 1 dB for 100 mm) compared to an existing element free from the small protrusions 13*a* and 13*b* and the recesses 12*a* and 12*b*. The range of 0.8 to 0.9 dB does not present significant problems for practical use.

Figure 3A:
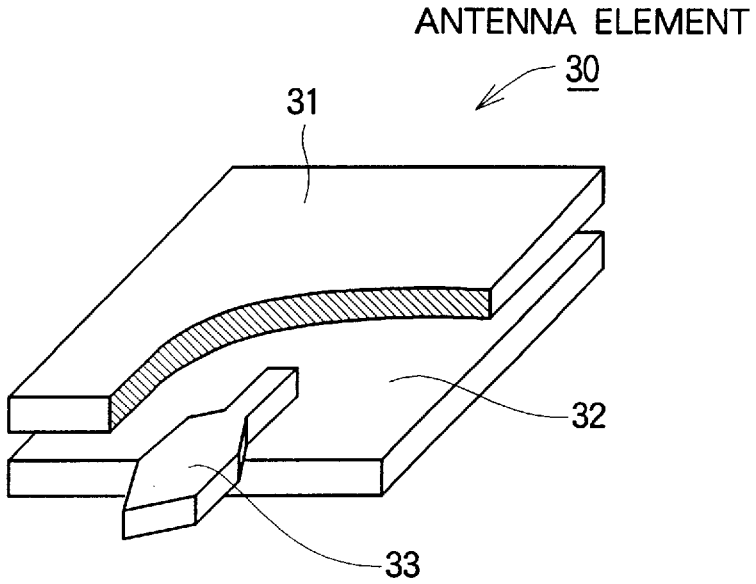
FIG. 3(*a*) is an illustration of an antenna element in accordance with the present invention.
Figure 3B:
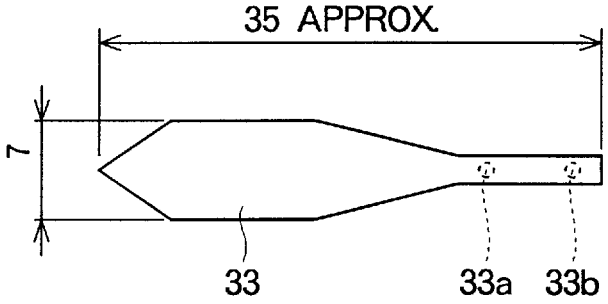
Figure 3C:
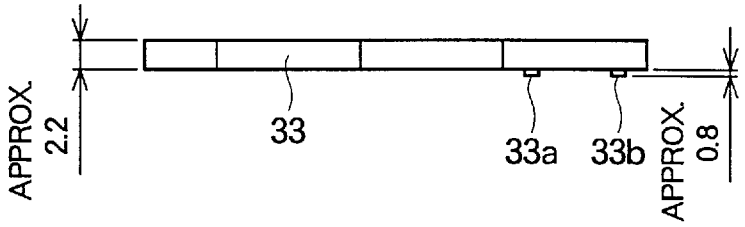

FIGS. 3(*a*)–(*c*) provide an illustration of an antenna element in accordance with a preferred form of the present invention. FIG. 3(*a*) is a perspective view of the element, FIG. 3(*b*) is a top view of an antenna block, and FIG. 3(*c*) is a side view of an antenna block.

An antenna element 30 is constructed by inserting the base end of a dielectric strip 33 serving as an antenna block between top and bottom parallel conductive plates 31 and 32. As shown in FIGS. 3(*b*) and 3(*c*), two small positioning protrusions 33*a* and 33*b* may be formed at the base end of the antenna block (dielectric strip) 33. The small protrusions 33*a* and 33*b* may be cylindrical and have a diameter of approx. 1.6 mm and a height of approx. 0.8 mm respectively. Though not illustrated, recesses to be fitted with the small protrusions 33*a* and 33*b* are formed on the bottom parallel conductive plate 32 correspondingly to the setting position of the dielectric strip 33 serving as an antenna block.

Figure 4:
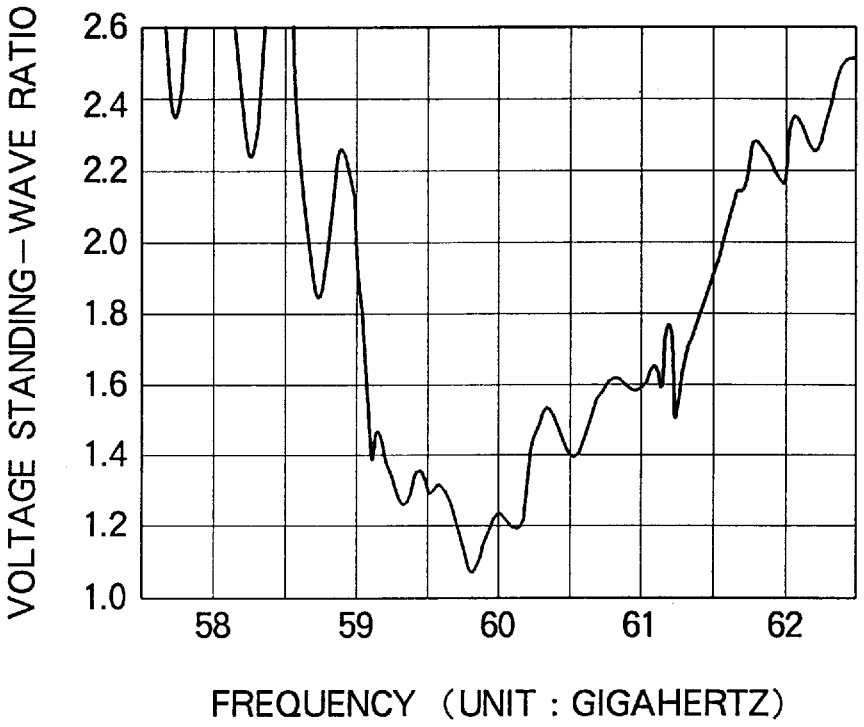
FIG. 4 is a graph showing the voltage standing-wave ratio characteristic of an antenna element.

FIG. 4 is a graph showing the voltage standing-wave ratio characteristic of an antenna element in accordance with the present invention.

As the result of measuring a voltage standing-wave ratio (VSWR) by using the antenna block (dielectric strip) 33, which was formed by combining the small protrusions 33*a* and 33*b* with molding material PFA, it is found that 2.5 GHz (59 to 61.5 GHz) serves as a frequency band in which the voltage standing-wave ratio (VSWR) comes to 2.0 or less to the central frequency of 60 GHz.

Because the antenna characteristic of the antenna element 30 is greatly changed due to the small protrusions 33*a* and 33*b* formed on the antenna block (dielectric strip) 33 and the recesses 32*a* and 32*b* formed on the bottom parallel conductive plate 32, the shape and the setting position of the antenna block (dielectric strip) 33 may need to be varied in a case by case manner.

Figure 5A:
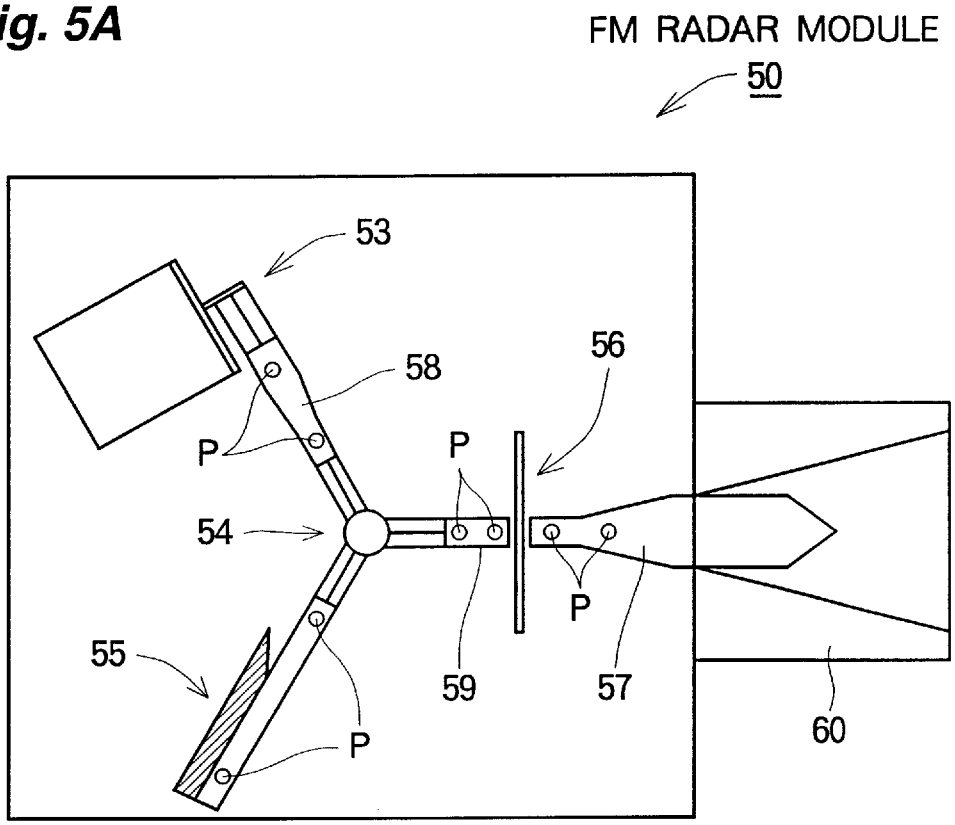
FIG. 5(*a*) is an illustration of a FM radar module in accordance with the present invention.
Figure 5B:
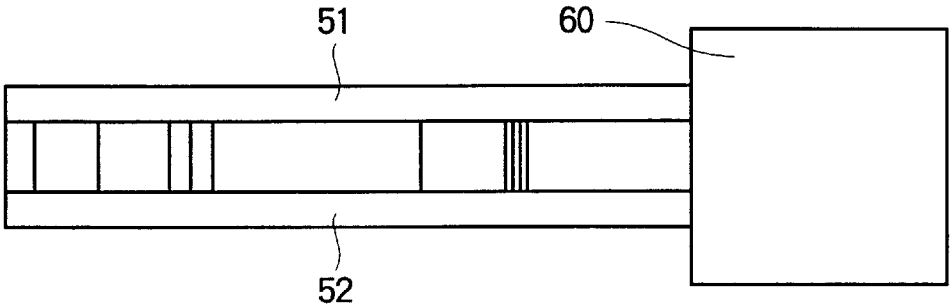
Figure 6:
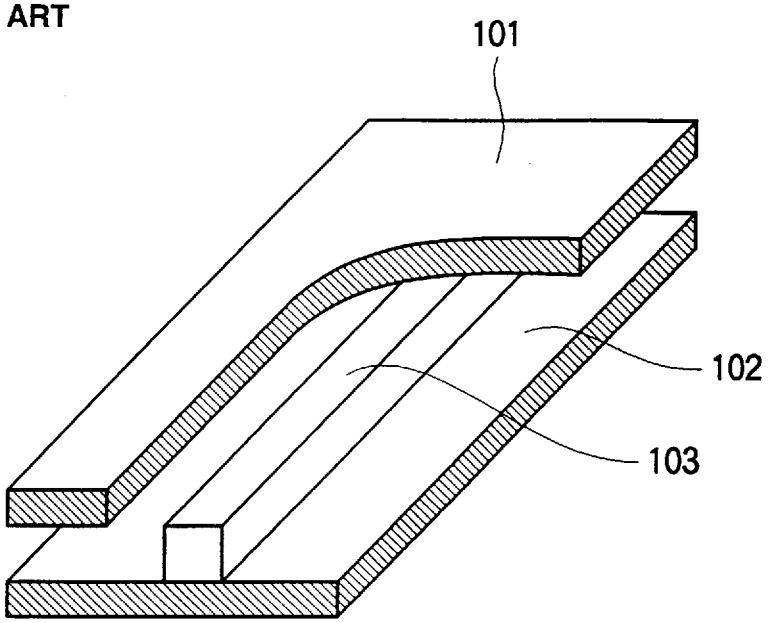
Fig. 6 PRIOR ART
FIG. 6 is a perspective view showing the basic structure of an existing NRD guide.
Figure 7:
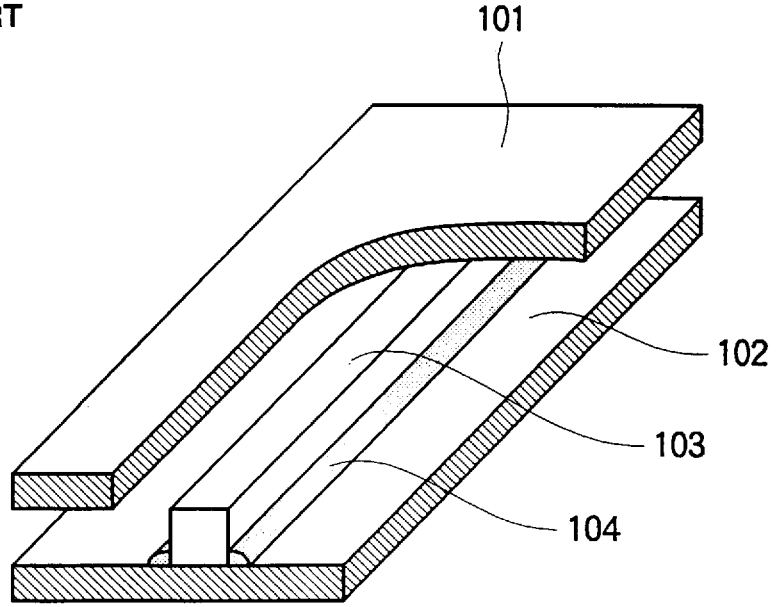
Fig. 7 PRIOR ART
FIG. 7 is a perspective view of an existing NRD guide provided with a dam for prevention of positional deviation.

FIGS. 5(*a*) and 5(*b*) provide an illustration of a FM radar module constituted by using the NRD-guide circuit element of the present invention. FIG. 5(*a*) is a top view of the module, and FIG. 5(*b*) is a side of the module.

An FM radar module 50 is constituted by setting various circuit elements such as a FM signal generator 53, a circulator 54, a nonreflective terminal 55, a mixer circuit 56, and antenna block 57, and NRD guides (nonradiative dielectric waveguides) 58 and 59 at predetermined positions between top and bottom parallel conductive plates 51 and 52 respectively. Symbol 60 represents a horn of a send-and-receive antenna.

Moreover, each of dielectric strips constituting the antenna block 57 and NRD guides 58 and 59 is provided with two small protrusions P for positioning and the bottom parallel conductive plate 52 is provided with a recess (not illustrated) corresponding to each small protrusion P at a position where each dielectric strip should be arranged.

Therefore, each of the dielectric strips constituting the antenna block 57 and the NRD guides 58 and 59 is positioned only by making the small protrusion P fit a recess and the position of each dielectric strip is prevented from deviating. Moreover, because the arrangement interval of the small protrusion P is made different for each dielectric strip, it is possible to prevent each dielectric strip from being erroneously arranged in different position on conductive plate 2.

As for each embodiment, a structure is described in which a recess is formed at a bottom parallel conductive plate and a small protrusion is formed at the bottom of a dielectric strip. However, it is also possible to form a small protrusion at the top of a dielectric strip. Moreover, it is possible to specify the positional relation between top and bottom parallel conductive plates by forming a small protrusion at the top and bottom of a dielectric strip respectively. In the case of the NRD guide and the NRD-guide circuit element of the present invention, because at least two small protrusions for positioning are formed on a dielectric strip and a corresponding recess is formed on a parallel conductive plate as described above, the dielectric strip is positioned by fitting each small protrusion into each corresponding recess. Moreover, because the two small protrusions are separated, the dielectric strip is not rotated. Therefore, it is possible to easily set and position the dielectric strip and prevent the position of the dielectric strip from deviating. Thus, the fabrication performance of the dielectric strip can be improved.

Finally, while the invention is susceptible to various modifications and alternative forms, specific examples thereof have been shown by way of example in the drawings and are herein described in detail. It should be understood, however, that the invention is not to be limited to the particular forms or methods disclosed, but to the contrary, the invention is to cover all modifications, equivalents, and alternatives falling within the spirit and scope of the appended claims.

What is claimed is:

1. A method of manufacturing a NRD guide comprising the steps of:

providing a dielectric strip, a first parallel conductive plate, and a second parallel conductive plate;

providing on a joint surface of said dielectric strip a plurality of discrete protrusions;

providing in a joint surface of said first parallel conductive plate a plurality of discrete recesses for receiving and mating with said plurality of discrete protrusions provided on said joint surface of said dielectric strip; and setting said dielectric strip between said first and second parallel conductive plates such that said protrusions of said dielectric strip are disposed within said recesses of said first parallel conductive plate, with said first joint surface and said second joint surface being in contact with each other.

2. A linear waveguide element for measuring transmission loss, said linear waveguide element comprising:

a linear dielectric strip fixedly disposed between a first parallel conductive plate and a second parallel conductive plate;

said linear dielectric strip having a first joint surface and a plurality of discrete raised protrusions formed on said first joint surface; and said first parallel conductive plate having a second joint surface and a plurality of discrete recesses formed in said second joint surface, said recess in said second joint surface receiving and mating with said protrusions of said linear dielectric strip, with said first joint surface and said second joint surface being held in contact with each other.

3. The linear waveguide element of claim 2 wherein said linear dielectric strip is constructed from a fluoroplastic material and has a width of 2.35 mm, a height of 2.2 mm, and a length of 70 mm; and wherein said parallel conductive plates are 70 mm in length and 70 mm in width.

4. The linear waveguide element of claim 3 wherein a first of said raised protrusions is disposed at a distance of 5 mm from one end of said linear dielectric strip along a first axis of said linear dielectric strip; and a second of said raised protrusions is disposed at a distance of 7.5 mm from said first raised protrusion along said first axis.

5. The linear waveguide of claim 4 wherein said raised protrusions are substantially cylindrical in shape, have a diameter of 1.6 mm, and have a height of 0.8 mm.

6. An antenna element comprising:

a linear dielectric strip fixedly disposed between a first parallel conductive plate and a second parallel conductive plate;

said linear dielectric strip having a base portion, said base portion of said linear dielectric strip having a first joint surface and a plurality of discrete raised protrusions formed on said first joint surface; and said first parallel conductive plate having a second joint surface and a plurality of discrete recesses formed in said second joint surface, said recess in said second joint surface receiving and mating with said protrusions of said linear dielectric strip, with said first joint surface and said second joint surface being held in contact with each other.

7. A NRD guide comprising:

a dielectric strip disposed between first and second parallel conductive plates;

said dielectric strip having a first joint surface and at least two separate protrusions formed on said first joint surface; and said first parallel conductive plate having a second joint surface and at least two separate recesses formed in said second joint surface, each of said recesses receiving and mating with a corresponding one of said protrusions on said dielectric strip, with said first joint surface and said second joint surface being in contact with each other.

* * * * *